US007438671B2

(12) United States Patent
Wang

(10) Patent No.: US 7,438,671 B2
(45) Date of Patent: Oct. 21, 2008

(54) MANUAL PACE-ADJUSTING MECHANISM OF AN ELLIPTICAL CROSS TRAINER

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 11/647,454

(22) Filed: Dec. 29, 2006

(65) Prior Publication Data

US 2008/0161165 A1 Jul. 3, 2008

(51) Int. Cl.
*A63B 69/16* (2006.01)
*A63B 22/04* (2006.01)

(52) U.S. Cl. ..... 482/52; 482/57

(58) Field of Classification Search ..... 482/51, 482/52, 57, 70, 79–80
See application file for complete search history.

(56) References Cited

U.S. PATENT DOCUMENTS 5,242,343 A * 9/1993 Miller ..... 482/57
5,924,962 A * 7/1999 Rodgers, Jr. ..... 482/57
6,440,042 B2 * 8/2002 Eschenbach ..... 482/52
7,060,005 B2 * 6/2006 Carlsen et al. ..... 482/52
7,267,638 B2 * 9/2007 Wang ..... 482/52

* cited by examiner

*Primary Examiner*—Steve R Crow
(74) *Attorney, Agent, or Firm*—Troxell Law Office, PLLC

(57) ABSTRACT

A manual pace-adjusting mechanism of an elliptical cross trainer having an adjusting rod pivotally attached to both sides of the bottom support frame, respectively. The top end of the adjusting rod is pivotally coupled to an L-shaped connecting rod while the other end of the L-shaped connecting rod is pivotally connected to the treadle plank. A positioning rod is interposed between the adjusting rod and the front upright posts of the elliptical cross trainer by means of a positioning element. As a result, the adjustment of the angle of the adjusting rod enables the change on the vertical position of the treadle planks so that an independent right and left adjustment of the exercise pace is achieved.

1 Claim, 3 Drawing Sheets

MANUAL PACE-ADJUSTING MECHANISM OF AN ELLIPTICAL CROSS TRAINER

BACKGROUND OF THE INVENTION

1. Fields of the Invention

The invention relates to a pace-adjusting mechanism of an elliptical cross trainer, and more particularly, to a mechanism that permits a free and independent right and left adjustment of the exercise pace.

2. Description of the Related Art

The elliptical cross trainer allows an operator's feet to move in an elliptical path, thereby simulating the motions of running and/or walking. Moreover, the horizontal pace (simulating the movement on a flat ground) and the inclined pace (simulating the uphill and downhill movement) can be changed when the vertical position of the treadles of the elliptical cross trainer is changed.

The prior art's adjustment of the height of the treadle (via a manual or electrical mechanism) is designed for a synchronic adjustment of the left and right treadles. In this way, the treadles at both sides are maintained at the same height before and after the adjustment. However, this design cannot meet the different exercise and training requirements of each operator. In other words, the above-mentioned structure is not able to allow each foot to move at a different pace or to simulate a jogging exercise on a slope.

SUMMARY OF THE INVENTION

It is a primary object of the invention to provide a manual pace-adjusting mechanism of an elliptical cross trainer that replaces the synchronic adjusting mechanism and permits an independent right and left adjustment of the exercise pace. In this way, the operator can easily control the exercise pace of the left and right treadles separately according to his own requirements during the exercise session.

In order to achieve the above-mentioned object, a manual pace-adjusting mechanism of an elliptical cross trainer includes an adjusting rod pivotally attached to both sides of the bottom support frame, respectively. The top end of the adjusting rod is pivotally coupled to an L-shaped connecting rod while the other end of the L-shaped connecting rod is pivotally connected to the treadle plank. A positioning rod is interposed between the adjusting rod and the front upright posts of the elliptical cross trainer by means of a positioning element. As a result, the independent right and left adjustment of the exercise pace of each foot is achieved.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
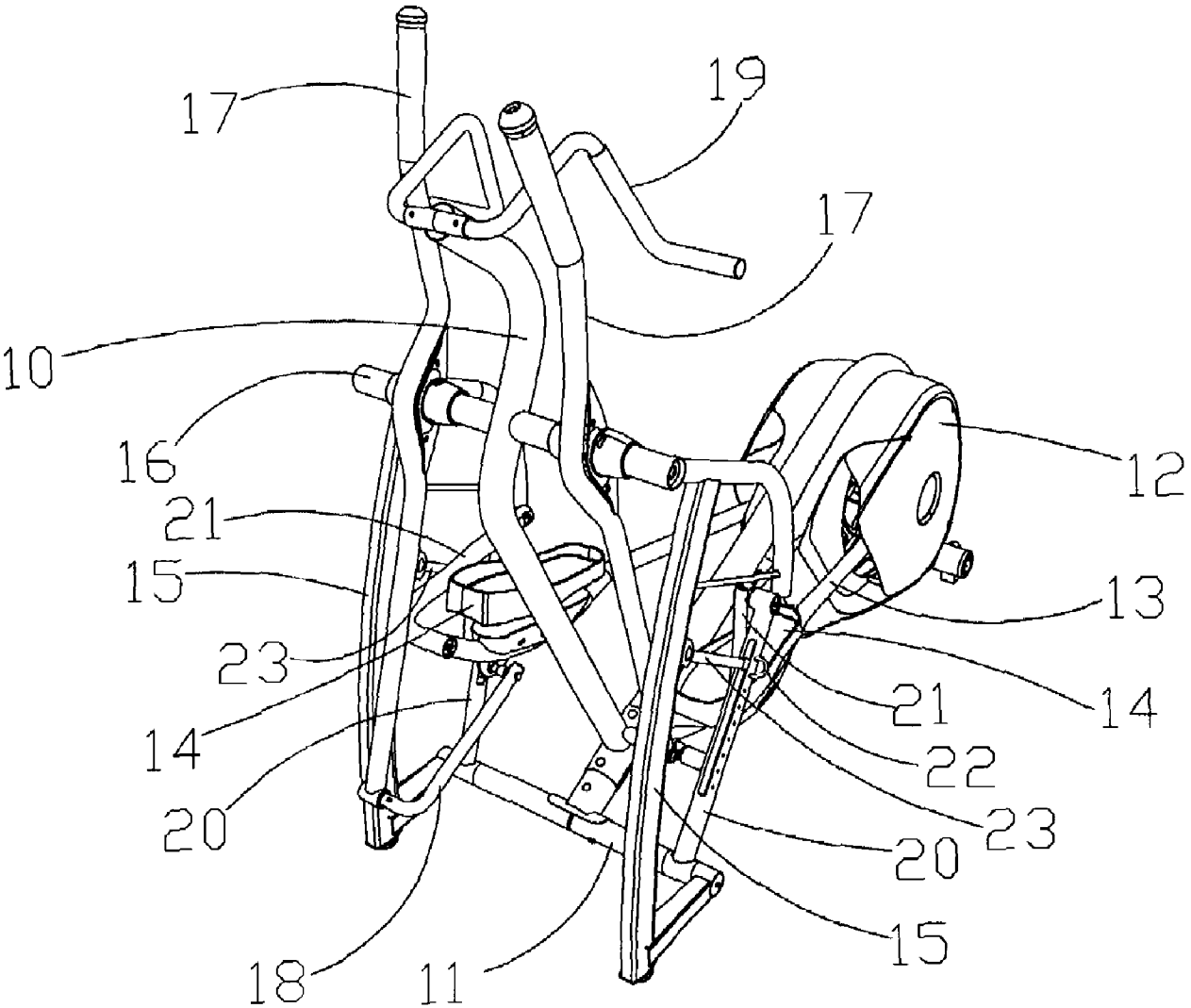
FIG. 1 is a perspective view of a preferred embodiment of the invention.
Figure 2:
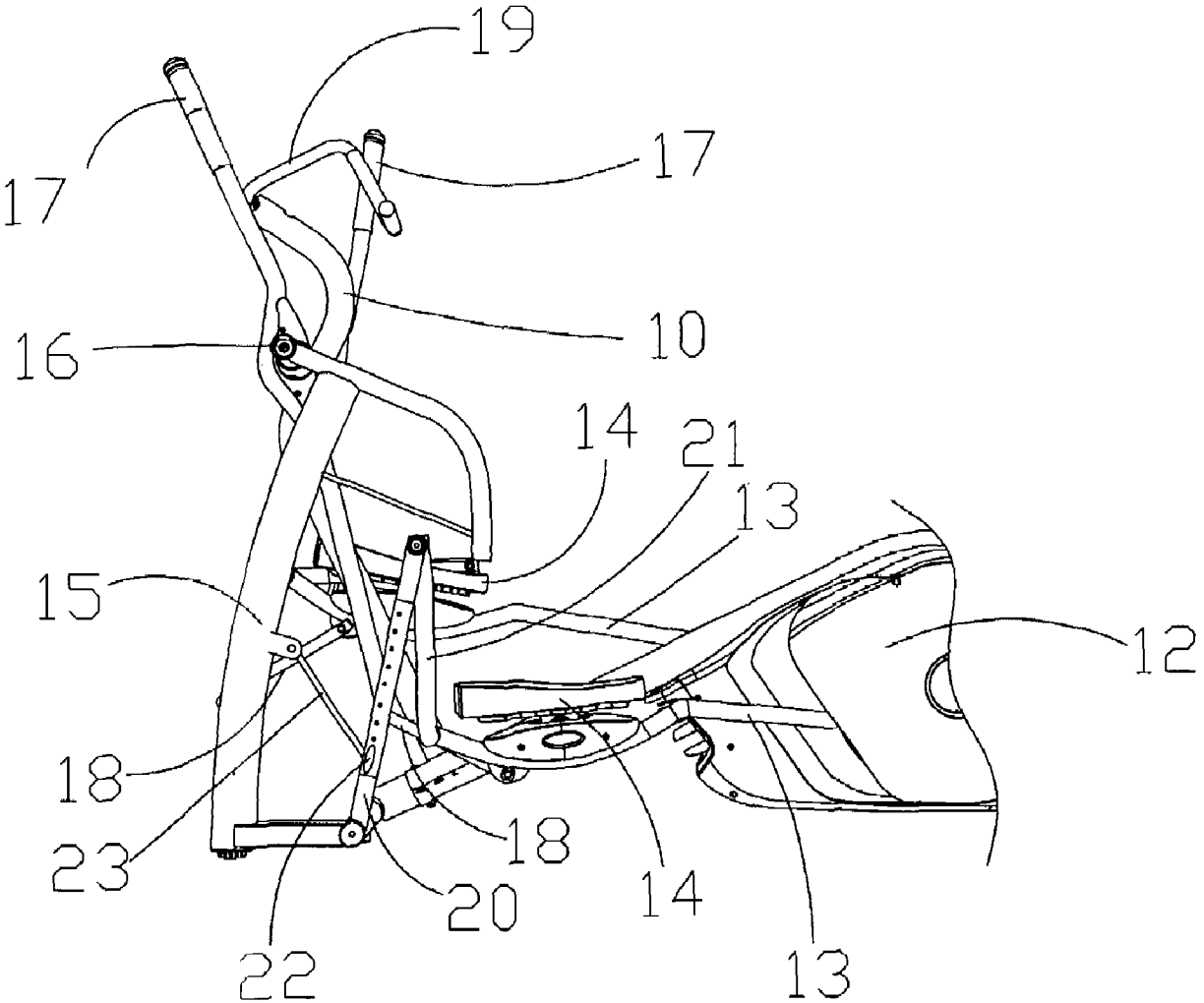
FIG. 2 is a side view of the embodiment according to FIG. 1.
Figure 3:
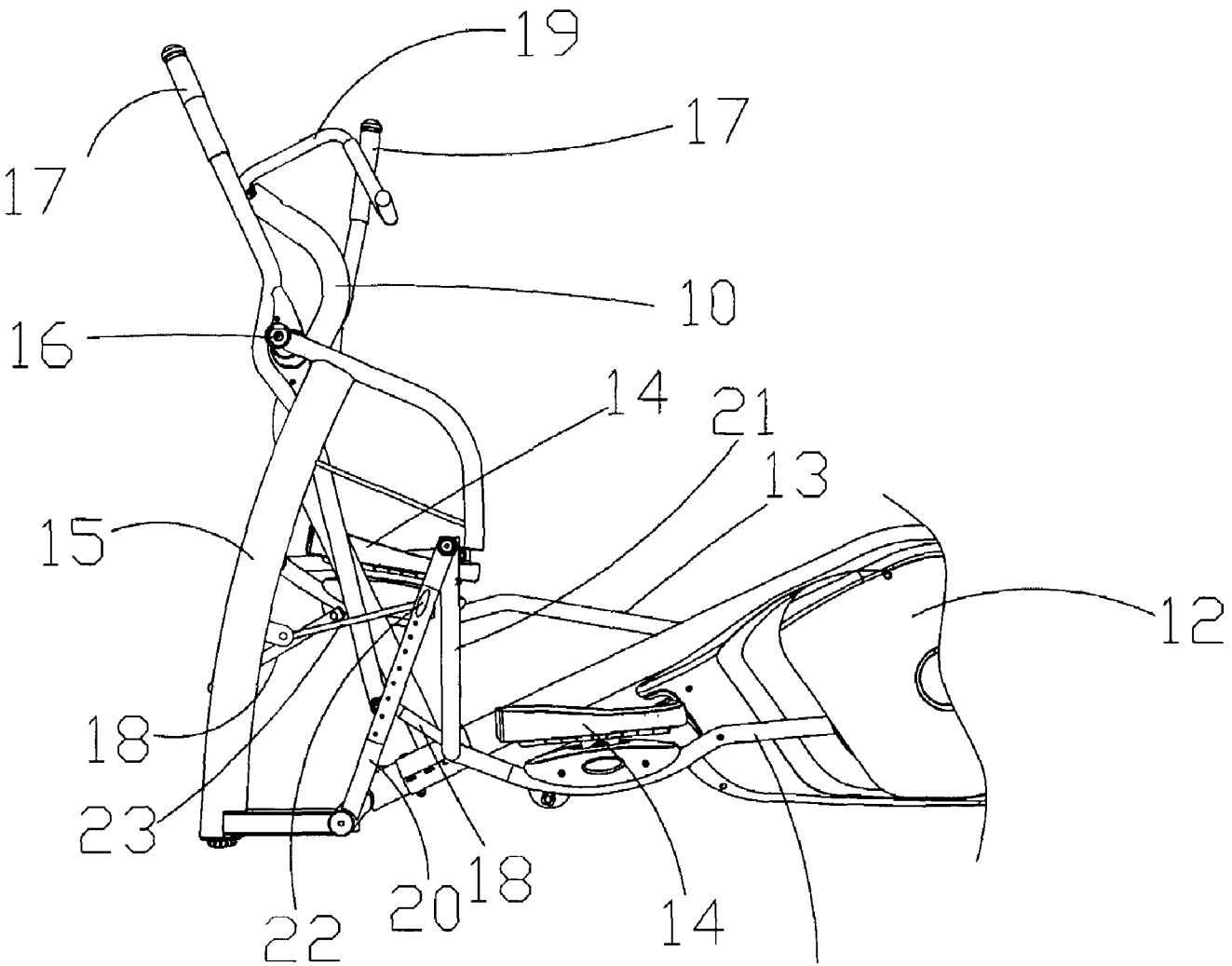
FIG. 3 is a schematic drawing of the adjustment of the invention.

Referring to FIGS. 1 through 3, a preferred embodiment of the invention includes a frame unit 10 with a bottom support frame 11 at the front end thereof and a flywheel transmission unit at the rear end thereof. The flywheel transmission unit is covered by a protection hood 12 so that it is not shown in the figures. The flywheel transmission unit works in cooperation with two treadle planks 13 on which a treadle 14 is disposed. Two movable handle rods 17 are pivotally mounted on a crossbar 16 between two upright posts 15. The bottom of the movable handle rods 17 is pivotally attached to a connecting rod 18. The other end of the connecting rod 16 is pivotally connected to the front section of the treadle plank 13, thereby creating a coupling action. Moreover, the top of the frame unit 10 is provided with a fixed handle rod 19.

An adjusting rod 20 is pivotally attached to both sides of the bottom support frame 11, respectively. The top end of the adjusting rod 20 is pivotally coupled to an L-shaped connecting rod 21 while the other end of the L-shaped connecting rod 21 is pivotally connected to the treadle plank 13. A positioning rod 23 is interposed between the adjusting rod 20 and the upright posts 15 by means of a positioning element 22. In this way, the adjustment of the angle of the adjusting rod 20 enables a change of the vertical position of the treadle planks 13. Accordingly, an independent right and left adjustment of the exercise pace is achieved.

In operation, the positioning element 22 has to be released first before adjusting the position of the adjusting rod 20. After adjustment, the positioning element 22 is returned so that the positioning rod 23 is linked to the adjusting rod 20.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A manual pace-adjusting mechanism of an elliptical cross trainer, comprising:

a frame unit with a bottom support frame at a front end of the frame unit and a flywheel transmission unit at a rear end of the frame unit, a top of the frame unit being provided with a fixed handle rod;

two movable handle rods with each movable handle rod being pivotally mounted on a crossbar between two upright posts;

two connecting rods with one end of each of the connecting rods pivotally connected to a bottom of each of the movable handle rods;

two treadle planks cooperatively linked to the flywheel transmission unit, an other end of each of the connecting rods being pivotally connected to a front section of each of the treadle planks;

two adjusting rods with each of the adjusting rods being pivotally attached to opposite sides of the bottom support frame;

two L-shaped connecting rods with one end of each of the L-shaped connecting rods being pivotally coupled to a top end of each of the adjusting rods and an other end of each of the L-shaped connecting rods being pivotally connected to each of the treadle planks; and two positioning rods with each of the positioning rods being interposed between each of the adjusting rods and each of the front upright posts of the elliptical cross trainer by means of a removable positioning element, wherein adjusting an angle of each of the adjusting rods enables the independent adjustment of the vertical position of each of the treadle planks to allow independent adjustment of an elliptical path of an operator's right and left feet.

* * * * *